US007222733B2

(12) United States Patent
Kim

(10) Patent No.: US 7,222,733 B2
(45) Date of Patent: May 29, 2007

(54) GOLF CLUB TRAVEL BAG

(76) Inventor: Young S. Kim, 1612 Cortedia, Los Altos, CA (US) 94024

( * ) Notice: Subject to any disclaimer, the term of this patent is extended or adjusted under 35 U.S.C. 154(b) by 37 days.

(21) Appl. No.: 10/797,370

(22) Filed: Mar. 9, 2004

(65) Prior Publication Data

US 2005/0199519 A1 Sep. 15, 2005

(51) Int. Cl.
*A63B 55/00* (2006.01)

(52) U.S. Cl. ..... 206/315.3; 206/315.4; 206/315.5; 206/315.6; D3/320

(58) Field of Classification Search ..... 206/315.3, 206/315.5, 315.6, 315.4; D3/318, 320; 280/DIG. 6
See application file for complete search history.

(56) References Cited

U.S. PATENT DOCUMENTS

| | | | | | |
|---|---|---|---|---|---|
| 2,685,317 | A | * | 8/1954 | Lace et al. | 206/315.6 |
| 2,879,819 | A | * | 3/1959 | Turnbull | 206/315.4 |
| D211,956 | S | * | 8/1968 | Christie | D3/320 |
| 4,142,563 | A | * | 3/1979 | Ackerfeldt et al. | 206/315.5 |
| 4,332,283 | A | * | 6/1982 | Rader | 206/315.6 |
| 4,383,563 | A | | 5/1983 | Kirchhoff, Jr. | |
| D272,285 | S | * | 1/1984 | Gillett | D34/15 |
| 4,522,299 | A | | 6/1985 | Clark et al. | |
| 4,767,001 | A | | 8/1988 | Kim | |
| 4,779,725 | A | * | 10/1988 | Gerber | 206/315.3 |
| 4,905,827 | A | | 3/1990 | Kim | |
| D315,639 | S | * | 3/1991 | Warder | D3/320 |
| 5,071,147 | A | * | 12/1991 | Stansbury | 280/47.19 |
| 5,074,577 | A | | 12/1991 | Kim | |
| 5,228,566 | A | * | 7/1993 | Shenoha | 206/315.6 |
| 5,465,839 | A | * | 11/1995 | Gretz | 206/315.3 |
| 5,819,829 | A | * | 10/1998 | Matthews | 150/159 |
| 5,860,519 | A | * | 1/1999 | Meyer et al. | 206/315.3 |
| 5,911,322 | A | * | 6/1999 | Lombardo et al. | 206/315.3 |
| 5,927,361 | A | | 7/1999 | Sanderson et al. | |
| 5,954,199 | A | * | 9/1999 | Stratton | 206/315.6 |
| D427,431 | S | * | 7/2000 | Jensen | D3/255 |
| D431,111 | S | * | 9/2000 | Ryan | D3/320 |
| 6,161,692 | A | | 12/2000 | Lizarraga | |
| 6,328,161 | B1 | * | 12/2001 | Kang | 206/315.3 |
| 6,330,944 | B1 | * | 12/2001 | DeMichele | 206/315.3 |
| 6,557,702 | B1 | | 5/2003 | Sanderson et al. | |
| 6,564,936 | B1 | | 5/2003 | Campbell | |
| 6,612,412 | B2 | | 9/2003 | Sanderson et al. | |
| 6,629,601 | B1 | | 10/2003 | Russell | |

FOREIGN PATENT DOCUMENTS

| | | | | |
|---|---|---|---|---|
| JP | 200084129 | A | * | 3/2000 |

* cited by examiner

*Primary Examiner*—Sue A. Weaver
(74) *Attorney, Agent, or Firm*—Dorsey & Whitney LLP

(57) ABSTRACT

A golf travel bag is disclosed which protects the golf clubs during travel and storage and which can be used in playing a round of golf. The golf bag includes a shell which is generally of parallelpiped shape. The top of the golf bag slants upwardly and is provided with stepped golf clubs dividers which include apertures for receiving golf clubs at the thread of each step. The golf bag includes pockets for carrying golf accessories.

12 Claims, 5 Drawing Sheets

GOLF CLUB TRAVEL BAG

BRIEF DESCRIPTION OF THE INVENTION

This invention relates generally to golf club travel bags and more particularly to a multipurpose golf club travel bag which protects golf clubs during travel and is usable in playing rounds of golf.

BACKGROUND OF THE INVENTION

Generally golf bags used by most golfers during play are made of a flexible fabric. However, many golfers travel by air or other modes of transportation to various locations to play golf. A conventional bag is not suitable for transporting golf clubs from place to place because the bag offers minimum protection to the clubs during baggage handling.

Flexible and rigid travel covers are available in which the regular fabric golf bag is placed to protect the golf clubs during transport. When arriving at the destination the golf bag must be removed from the cover for play at the new location. The flexible or rigid travel cover must be stored.

It would be advantageous if there were available a multipurpose golf bag, that is a golf bag which protects the golf clubs during travel and storage and provides for storing golf accessories such as shoes, balls, tees, markers, gloves, etc., and which also can be used for playing a round of golf.

Generally, the golf clubs are carried in a golf bag by inserting the shafts from the top of the bag with the heads extending upwardly. The golf club bags have apertures at the top for separating one or more of the clubs and minimizing contact between the clubs. However, since the club shaft length varies between that of drivers to that of sand wedges many of the clubs in a set extended above the apertures a length which depends on the clubs. During play and transport the heads may strike one another or the shaft of adjacent clubs which can result in damage to the heads and shafts.

OBJECTS AND SUMMARY OF THE PRESENT INVENTION

It is therefore a general object that the present invention to provide a golf bag which can be used both for safe transport of clubs and for regular play which is configured with a stepped divider which includes apertures at each thread to engage all of the clubs near their heads thereby minimizing lateral movement and therefore minimize potential damage to the clubs.

Another object of the invention is to provide a golf bag which includes a rigid body having a bottom which may be provided with wheels and a top end, which slants upwardly from the front to the back and is provided with a stepped divider which includes apertures for receiving the golf shafts whereby the heads are prevented from striking adjacent clubs.

There is provided a gold travel bag having a one piece outer shell having front, back, side walls, a bottom and an open top with at least one stepped club divider having one or more apertures at each step thread for receiving the golf clubs. The travel bag includes at least one cover for closing the bag during travel and storage and pockets for storing accessories.

It is a further object of the invention to provide a multipurpose golf bag as described above, which includes flexible pockets for storing accessories such as shoes, balls, gloves, etc.

BRIEF DESCRIPTION OF THE DRAWINGS

The invention will be more clearly understood from the following description when read in conjunction with the accompanying drawings of which.

DETAILED DESCRIPTION OF THE PREFERRED EMBODIMENTS

Figure 2:
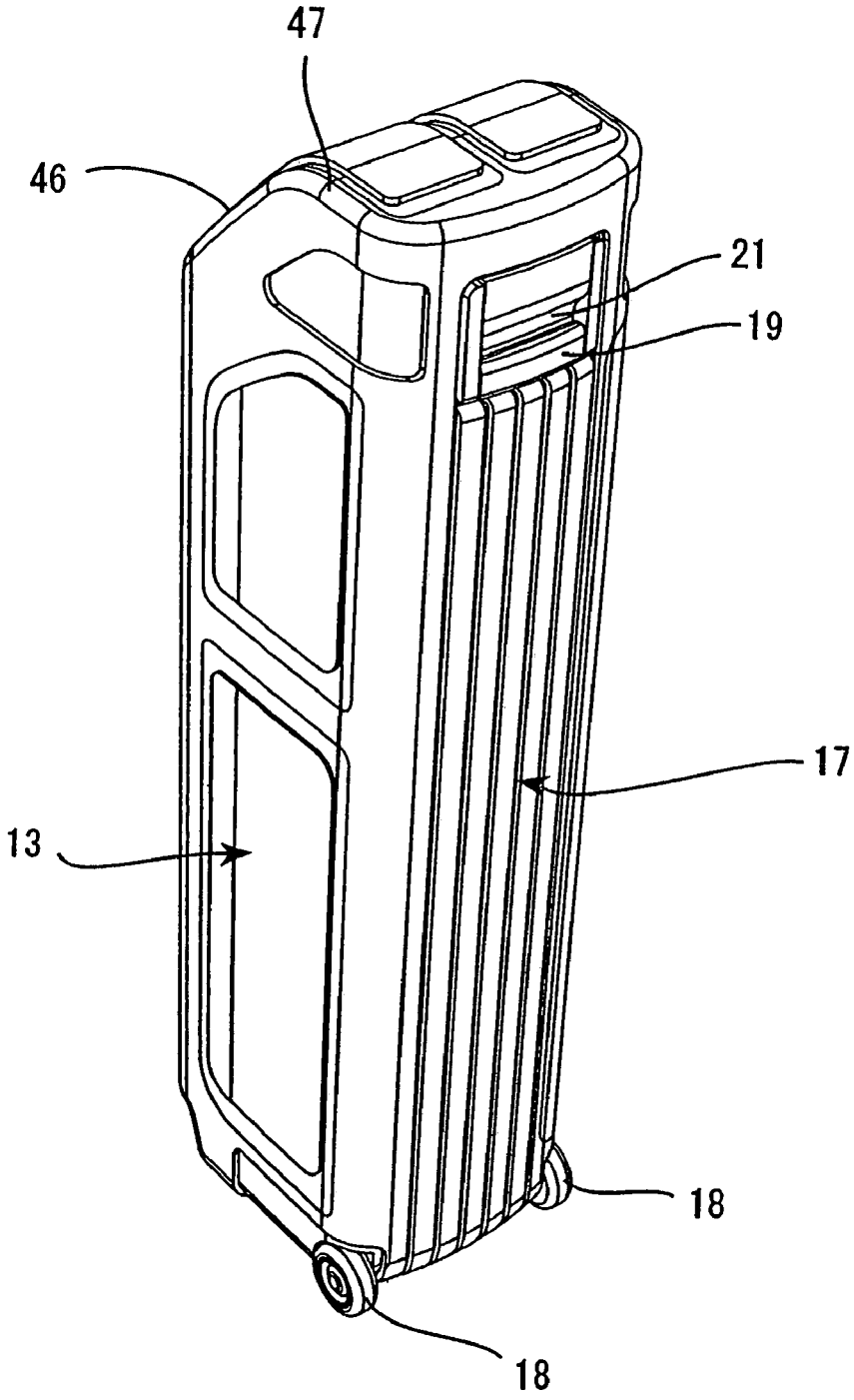
FIG. 2 is a back side perspective view of the assembled multipurpose golf bag.
Figure 3:
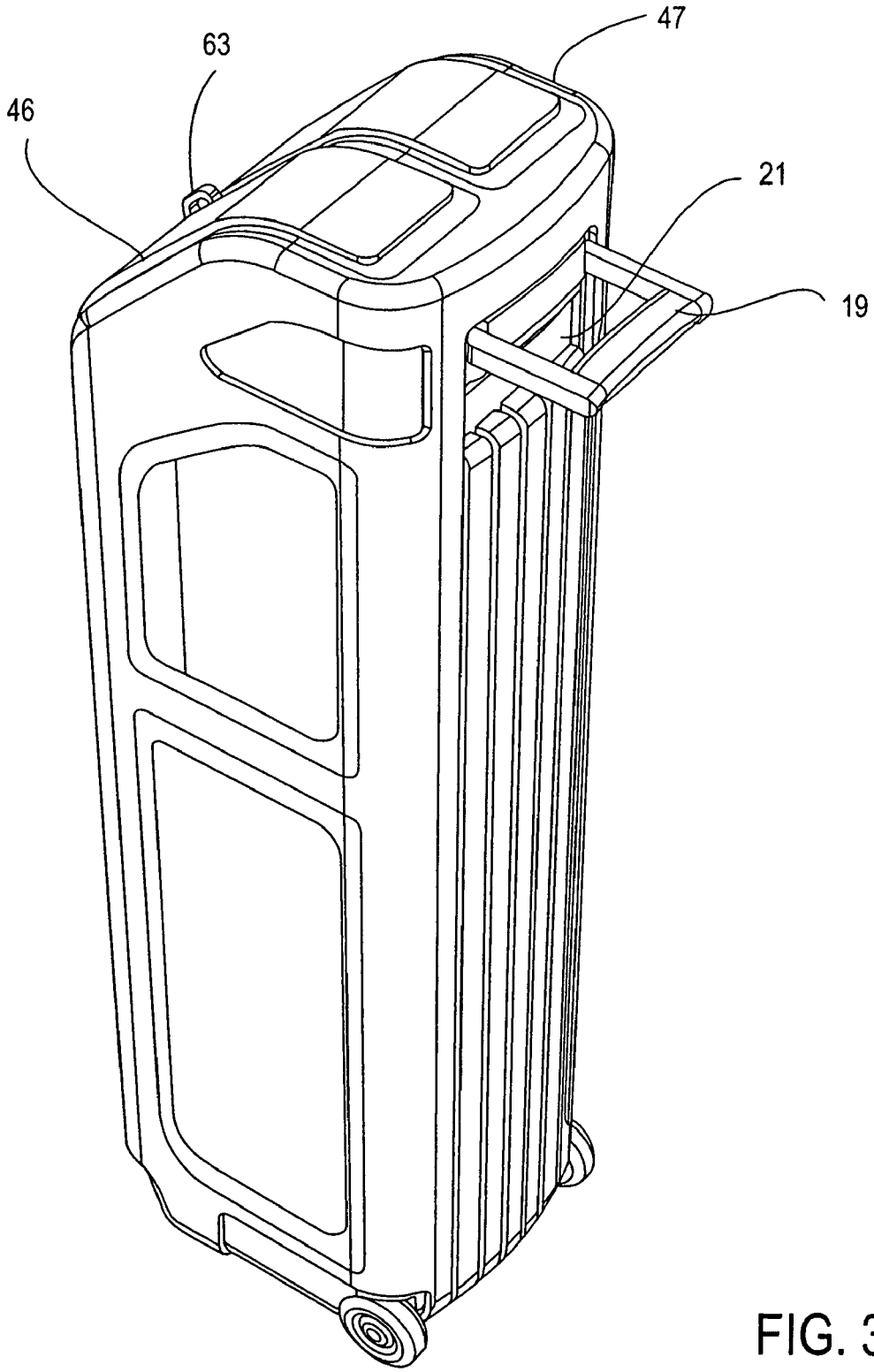
FIG. 3 is a back, side perspective view showing the pull handle for pulling the golf bag.

The golf bag according to the present invention comprises an outer shell in the general shape of a parallelpiped with rounded corners. The bag is preferably molded from semi-rigid material such as that used in the manufacture of plastic airline luggage and alike. The bag 10 includes front, back, and sidewalls 11, 12, 13, and 14 with an integral bottom 16. Referring to FIGS. 2 and 3 the back wall includes strengthening ribs 17. In the preferred embodiment wheels 18 are mounted on the bottom of at the rear wall. The back includes a hinged handle 19 for pulling the golf bag. In FIG. 2 the handle is folded into the recess 21 formed on the back wall, and in FIG. 3 it is rotated out for grasping and pulling the golf bag.

Figure 1:
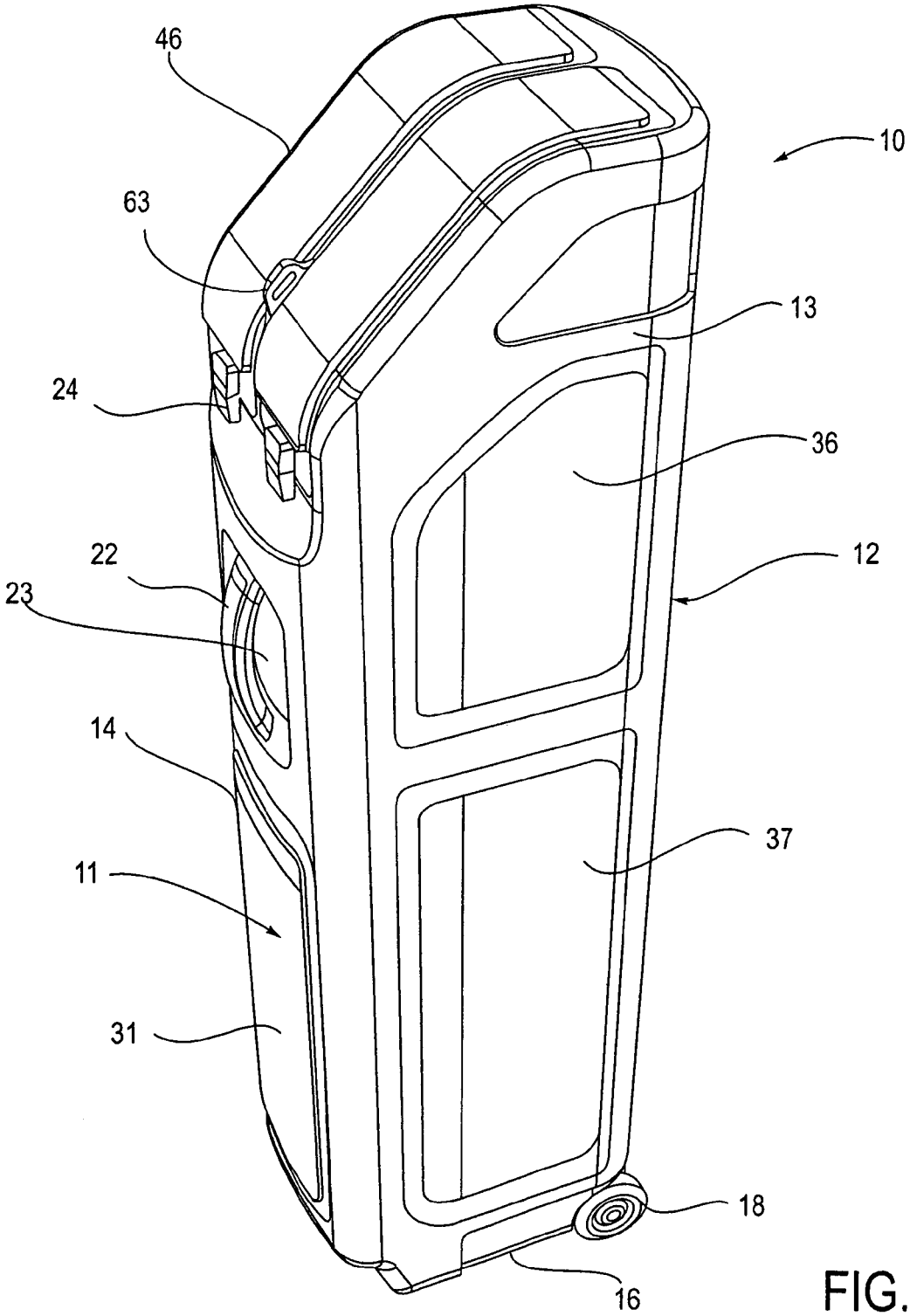
FIG. 1 is a front side perspective view of the multipurpose golf bag assembled for storage or travel.
Figure 4:
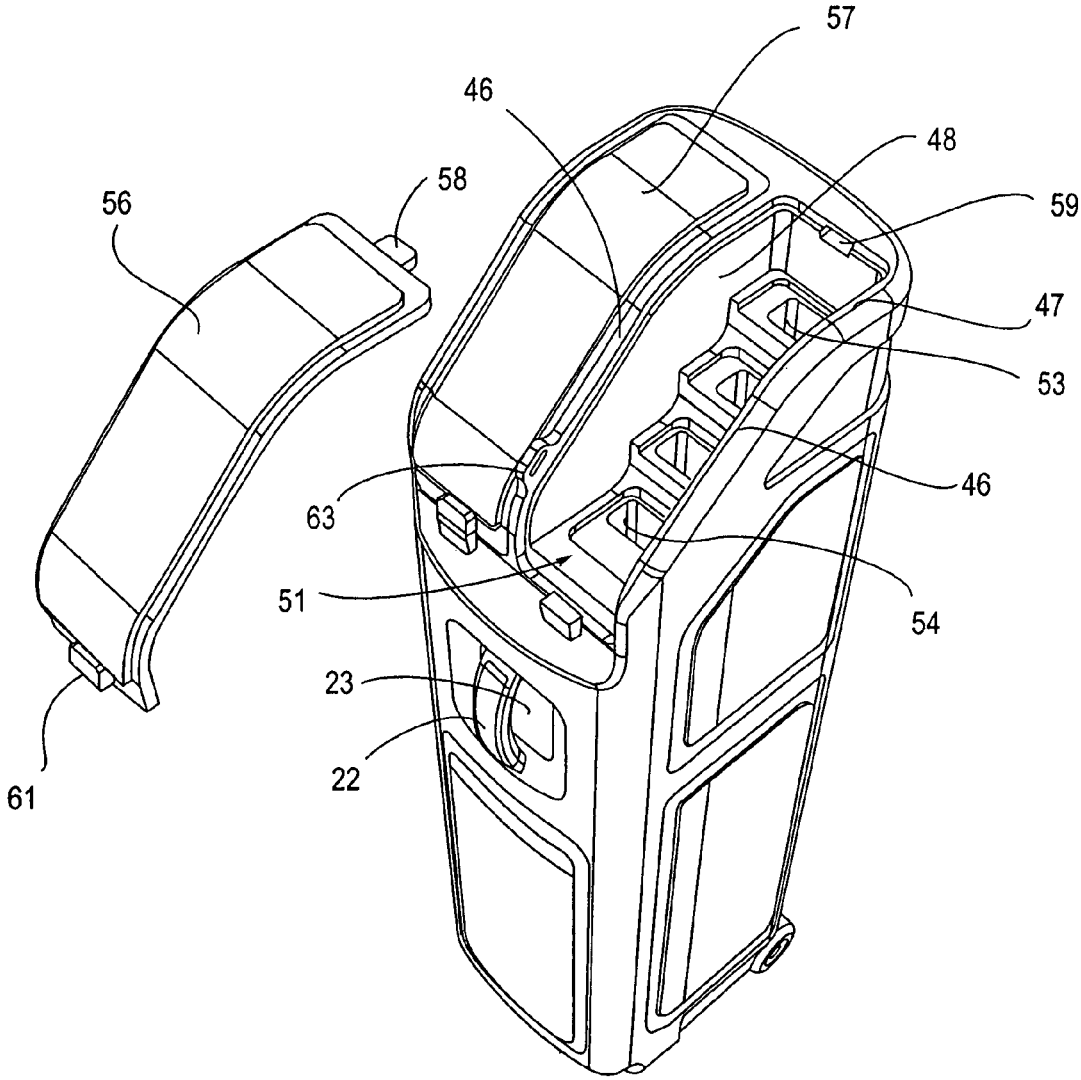
FIG. 4 is a front, side perspective view of the golf bag with one protective cover removed to show the stepped divider.
Figure 5:
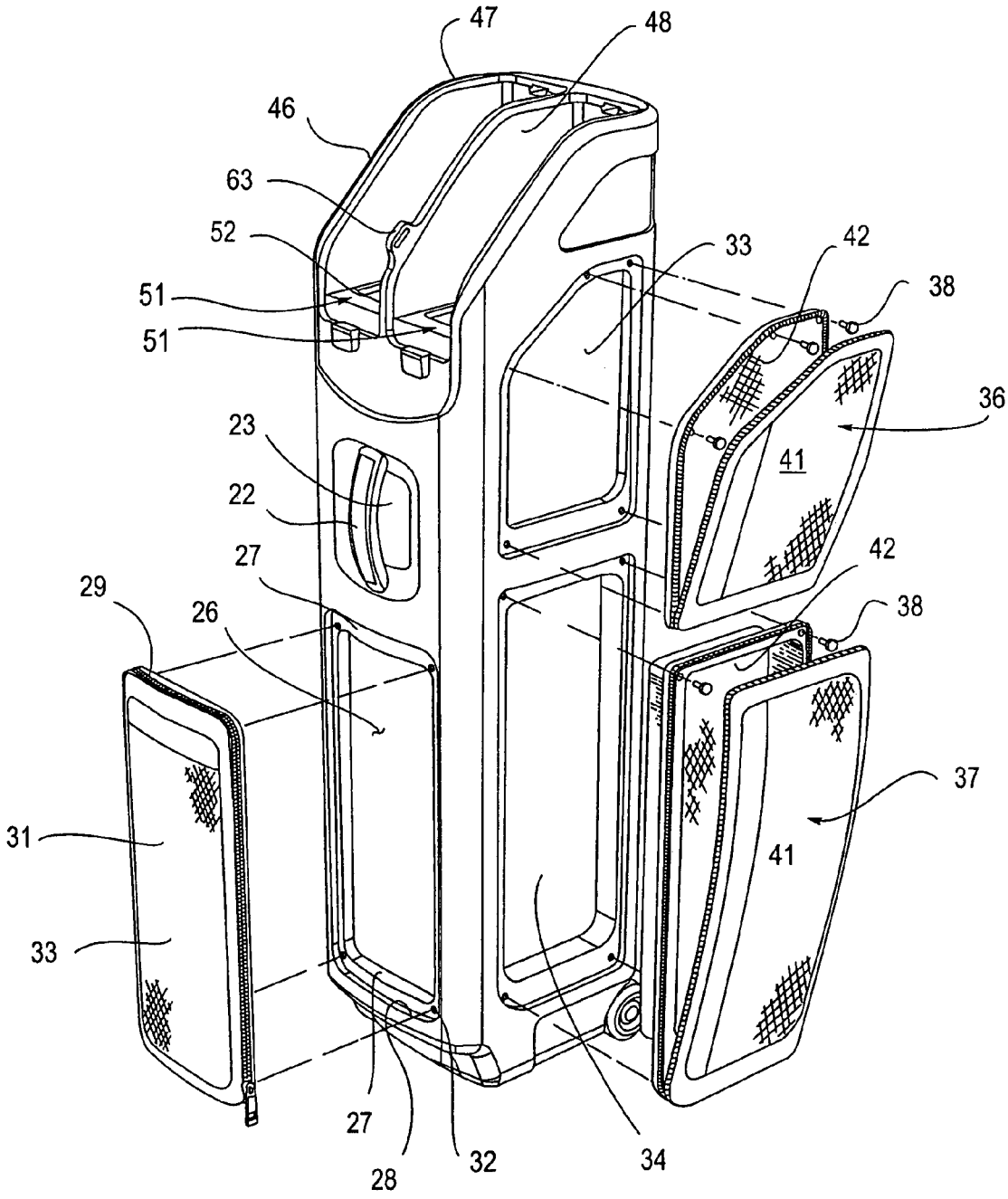
FIG. 5 is a front, side perspective exploded view of the golf bag showing the pockets for storing accessories.

The front wall FIGS. 1, 3 and 4 includes a carrying handle 22 which is accommodated in the recess 23. The upper end of the front wall is recessed to accommodate latches 24. Referring FIG. 5, the front wall includes an opening 26 with an inwardly extending rim 27. The wall is recessed 28 to receive the edges 29 a zippered pocket 31. The edges are secured to the outer shell by screws (not shown) which engage holes 32 formed at the corners of the recessed opening. The pocket includes a fabric cover 33 which is zippered to the bottom of the pocket. The bottom or back of the pocket is provided with an elastic fabric (not shown) so that the pocket is expandable into the interior of the shell to accommodate golf accessories. At least one sidewall of the shell is includes recessed and rimmed openings 33 and 34 which receive zippered pockets 36 and 37 secured to the shell by screws 38. The pockets include fabric covers 41 and bottom or backs of elastic material 42 to accommodate golf accessories. When the pockets 31, 36 and 37 are secured to the shells, they are substantially co-planar with the bag exterior thereby minimizing the possibility of snagging the pockets during transport.

The top of the recessed portion of the rigid shell slants upwardly from the front wall to the back wall as illustrated at 46 and flattens out at 47. In the preferred embodiment the top is partitioned by a wall 48. Stepped club dividers 51 are mounted within the partitioned top of the shell. The club dividers include apertures 52 at each step thread for receiving and accommodating the golf shafts. At least one of the club dividers 51, as illustrated in FIG. 4, has a least three steps. As can be appreciated the longer clubs, such as the driver and other woods are inserted in upper apertures 53 and clubs shorter shafts such as wedges are in the lower apertures 54. In this way the club shafts are engaged near the heads which limits lateral movement of the heads and minimizes damage to adjacent clubs. Furthermore the clubs are easily accessible during play.

The storage and travel bag includes covers 56 and 57 which are configured to match the top inclined edges of the bag and partition wall. Each cover includes a tab 58 which is inserted into the slot 59 formed on the rear wall of the bag. The cover is installed by placing the tab into the slot and lowering the front so that the tab 61 at the lower end of the cover meets the latch 24 for locking the cover in place. The divider includes an apertured tab 63 which may be used for locking the covers during transport.

The foregoing description is for purposes of explanation and understanding of the invention. However, it will be apparent to one skilled in the art that the specific details are not required in order to practice the invention. The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the fundamental principles of the invention and its practical applications, to thereby enable others skilled in the art to best utilize the invention and its various embodiments with various modifications as are suited to the particular use contemplated. It is intended that the scope of the invention be defined by the following claims and their equivalents.

What is claimed is:

1. A golf club travel bag comprising:

a one piece outer shell having front, rear and side walls and a closed bottom and an upper end which slopes upwardly from the front wall to the rear wall and is provided with first and second openings; and a stepped club divider mounted within each of the first and second openings in the sloped upper end of the bag, each club divider having a plurality of steps rising toward the rear wall and having at least one aperture in each step to receive a golf club.

2. A golf club travel bag as in claim 1 for use with golf clubs having respective heads in which the outer shell has a length such that golf clubs carried in the golf bag are engaged by the club dividers near their heads.

3. A golf club travel bag as in claim 1 or 2 including one or more covers for closing the first and second openings in the upper end of the bag during storage or travel.

4. A golf club travel bag as in claim 1 which includes wheels mounted at the bottom of the rear wall and a hinged handle mounted on the rear wall for pulling the golf bag.

5. A golf travel bag as in claim 4 including a handle mounted in a recess on the front wall for carrying the bag.

6. A golf travel bag as in claim 1, 4 or 5 in which the front wall and at least one side wall include openings and pockets secured in said openings for storing golf accessories secured to the shell and which extend into the shell.

7. A golf club travel bag as in claim 1 in which at least one of the stepped club dividers has at least three steps rising toward the rear wall.

8. A golf travel bag comprising:

a one piece outer generally parallelpiped shaped shell having a front, a rear and side walls, a closed bottom and an open upper end which slopes upwardly from the front wall to the rear wall, said shell including a partition wall at the upper end to form first and second openings in the upper end;

a club divider mounted within each of the first and second openings, each club divider having a plurality of apertures for receiving club shafts;

and first and second removable covers distinct from the shell for mounting to the shell to close the respective first and second openings.

9. A golf travel bag as in claim 8 wherein at least one of the walls is provided with an opening, a pocket adapted to store golf accessories mounted in the opening in the at least one of the walls and including a fabric front and flexible back with the front zippered to the back.

10. A golf travel bag as in claim 8 which includes openings in the front wall and at least one side wall and a pocket mounted in each opening.

11. A golf travel bag as in claim 8 including a recessed carrying handle on the front wall.

12. A golf travel bag as in claim 11 which includes wheels mounted at the bottom of the rear wall and a hinged handle mounted on the rear wall for pulling the golf bag.

* * * * *